US011014057B2

(12) United States Patent
Hudson

(10) Patent No.: US 11,014,057 B2
(45) Date of Patent: May 25, 2021

(54) CAULK TUBE

(71) Applicant: THE SHERWIN-WILLIAMS COMPANY, Cleveland, OH (US)

(72) Inventor: Richard D. Hudson, North Olmsted, OH (US)

(73) Assignee: The Sherwin-Williams Company, Cleveland, OH (US)

( * ) Notice: Subject to any disclaimer, the term of this patent is extended or adjusted under 35 U.S.C. 154(b) by 71 days.

(21) Appl. No.: 14/691,236

(22) Filed: Apr. 20, 2015

(65) Prior Publication Data

US 2015/0298160 A1 Oct. 22, 2015

Related U.S. Application Data

(60) Provisional application No. 61/981,888, filed on Apr. 21, 2014.

(51) Int. Cl.

| | |
|---|---|
| ***B01F 9/00*** | (2006.01) |
| ***B01F 11/00*** | (2006.01) |
| ***B01F 13/00*** | (2006.01) |
| ***B01F 15/00*** | (2006.01) |
| *B05C 17/01* | (2006.01) |

(52) U.S. Cl.

CPC ..... *B01F 9/003* (2013.01); *B01F 11/0008* (2013.01); *B01F 13/0023* (2013.01); *B01F 15/00896* (2013.01); *B01F 2215/005* (2013.01); *B05C 17/01* (2013.01)

(58) Field of Classification Search

CPC ..... B01F 9/003; B01F 15/00896; B01F 2009/0092; B01F 15/0883

USPC ..... 366/130

See application file for complete search history.

(56) References Cited

U.S. PATENT DOCUMENTS

| | | | | |
|---|---|---|---|---|
| 3,390,814 | A * | 7/1968 | Creighton, Jr. | B01F 11/0082 222/137 |
| 4,114,196 | A | 9/1978 | Lostutter | |
| 4,128,344 | A | 12/1978 | Blasetti | |
| 4,801,008 | A * | 1/1989 | Rich | B05C 17/00516 206/219 |
| 4,875,781 | A | 10/1989 | Raska | |
| 5,403,086 | A * | 4/1995 | Lindesay | B01F 9/0034 366/227 |
| 5,749,499 | A * | 5/1998 | Binder | B05C 17/00579 222/327 |
| 6,817,751 | B2 | 11/2004 | Huckby et al. | |
| 2003/0214876 | A1 | 11/2003 | Glass | |
| 2004/0173640 | A1 * | 9/2004 | Brandon | B05C 17/00553 222/327 |
| 2005/0198927 | A1 * | 9/2005 | Summons | B65D 83/0072 53/434 |

(Continued)

FOREIGN PATENT DOCUMENTS

| | | |
|---|---|---|
| DE | 10 2008 015 992 | 10/2009 |
| WO | 2000/033951 | 6/2000 |

(Continued)

*Primary Examiner* — Marc C Howell

(74) *Attorney, Agent, or Firm* — Ari Sherwin; Roger D. Emerson; Peter R. Detorre

(57) ABSTRACT

A caulk tube adapter for allowing mixing of coloring compositions into caulk is provided. The caulk tube includes baffles on the inside surface of the tube for facilitating mixing of the caulk and coloring composition. An adapter for allowing the caulk tubes to be positioned into a paint mixer is also provided.

9 Claims, 7 Drawing Sheets

(56) References Cited

U.S. PATENT DOCUMENTS

| | | | | |
|---|---|---|---|---|
| 2007/0278251 | A1* | 12/2007 | Guerrera | B05C 17/00576 222/327 |
| 2013/0250713 | A1* | 9/2013 | Agnello | B29B 7/14 366/98 |
| 2014/0043931 | A1* | 2/2014 | Figueroa | B01F 13/0011 366/130 |

FOREIGN PATENT DOCUMENTS

| | | |
|---|---|---|
| WO | 2001/017869 | 3/2001 |
| WO | 2002/051557 | 7/2002 |

* cited by examiner

CAULK TUBE

TECHNICAL FIELD

The present invention relates to a caulk tube useful for facilitating the mixing of dyes or tint into a caulk composition.

BACKGROUND

The present invention relates to a caulk tube useful for facilitating the mixing of dyes or tint into a caulk composition. In one embodiment of the invention, the caulk tube includes one or more baffles on the inner surface of the tube. In another embodiment, a static mixing device is secured to the outlet end of a caulk tube for mixing the tint or dye with the caulk as it is expelled from the tube. The invention also includes an adapter device for mixing a dye or tint with the caulk in a caulk tube using a paint shaker apparatus.

SUMMARY

Provided is a caulk tube. The caulk tube includes a hollow tube having a first end comprising an end wall with an outlet opening, a second end, a removable cap positioned on the second end, wherein the caulk tube comprises one or more baffles on the inside surface of the hollow tube.

Further provided is a method of tinting a caulk composition. The method includes the following steps: (a) providing a caulk tube comprising a hollow tube having a first end comprising an end wall with an outlet opening, a second end comprising an opening, a removable cap positioned on the second end, wherein the caulk tube comprises one or more baffles on the inside surface of the hollow tube, and wherein the hollow tube is filled with caulk; (b) removing the removable cap; (c) placing a coloring composition in opening at the second end; (d) replacing the cap on the second end of the caulk tube; (e) providing a paint mixer having an adapter for accommodating caulk tubes; (f) placing the caulk tube in the adapter; and (g) mixing the caulk and coloring composition using the paint mixer.

DETAILED DESCRIPTION OF ILLUSTRATED EMBODIMENTS

Figure 1:
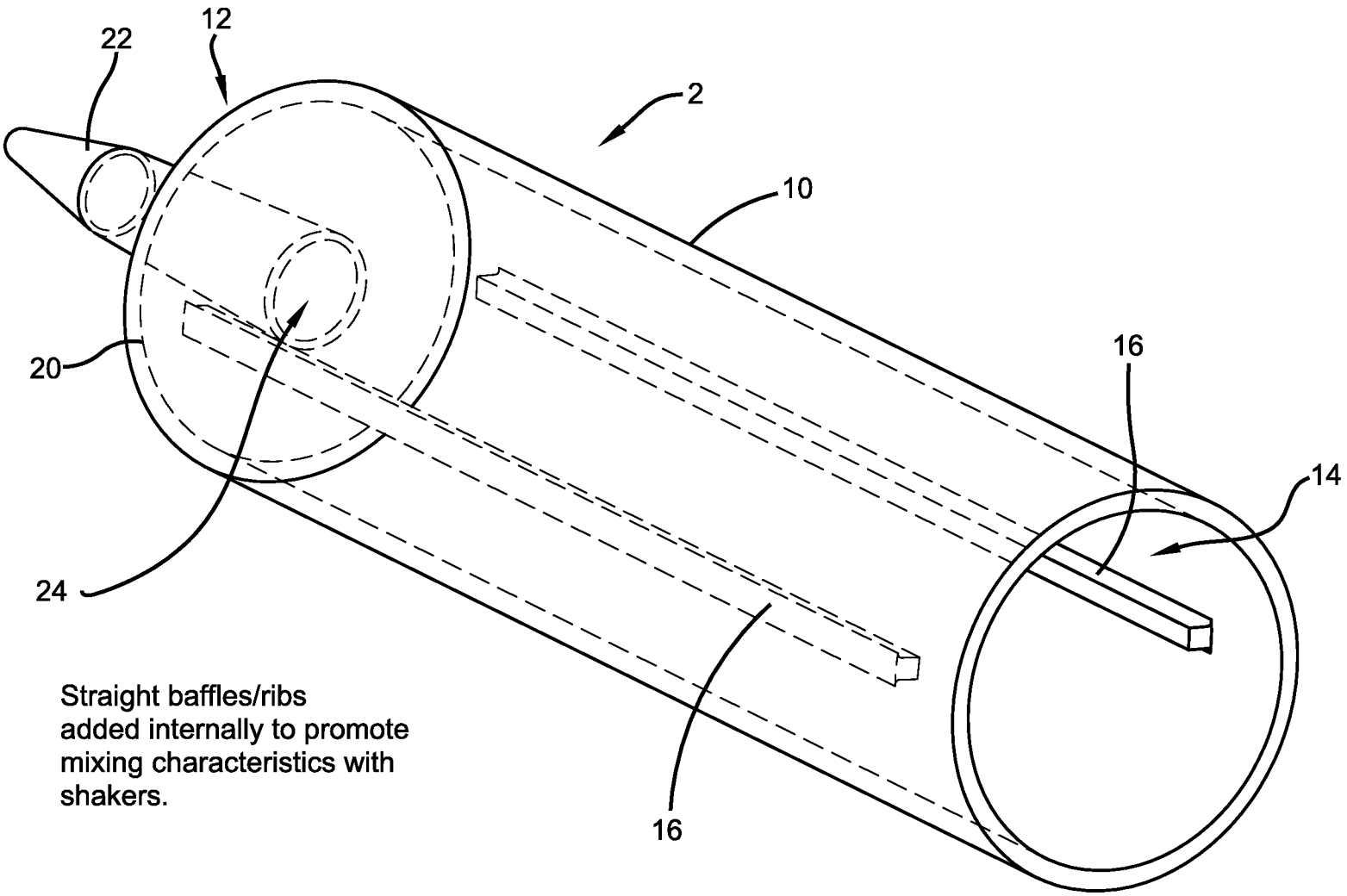
FIG. 1 illustrates a caulk tube in accordance with an embodiment of the invention.

A caulk tube in accordance with the present invention is illustrated in FIGS. 1-4. The caulk tube 2 includes a tube 10, having an elongated, cylindrical shaped portion, a first end 12 and an opposed second end 14. Joined to the first end is an end wall 20. End wall 20 has a centrally located outlet opening 24. The tube 10 and the end wall 20 define a recess such that the tube 10 is hollow. In one useful embodiment, the second end 14 of the tube is open. The tube 10 is loaded with caulk and a removable cap or lid (not shown) may be positioned on the second end 14 to close or seal the tube to prevent the caulk from drying out or leaking, as is well known in the art. The tube 12 may be made of plastic, cardboard, or any other suitable material known in the art. A tip 22 can be connected to the outlet opening 24 for dispensing of the caulk material. In one embodiment, the tip 22 may be connected to the outlet opening by means of threaded connectors or it may be formed as a unitary piece with the end wall. A caulk tube in accordance with the present invention may also include an piston or back plate (not shown) as are known in the art. The piston or back plate component is used for dispensing the caulk from the tube. The piston or back plate component is pushed along the hollow tube (either manually or by use of a caulk gun as is well known in the art) to force the caulk out of the tube through outlet opening and tip.

Figure 2:
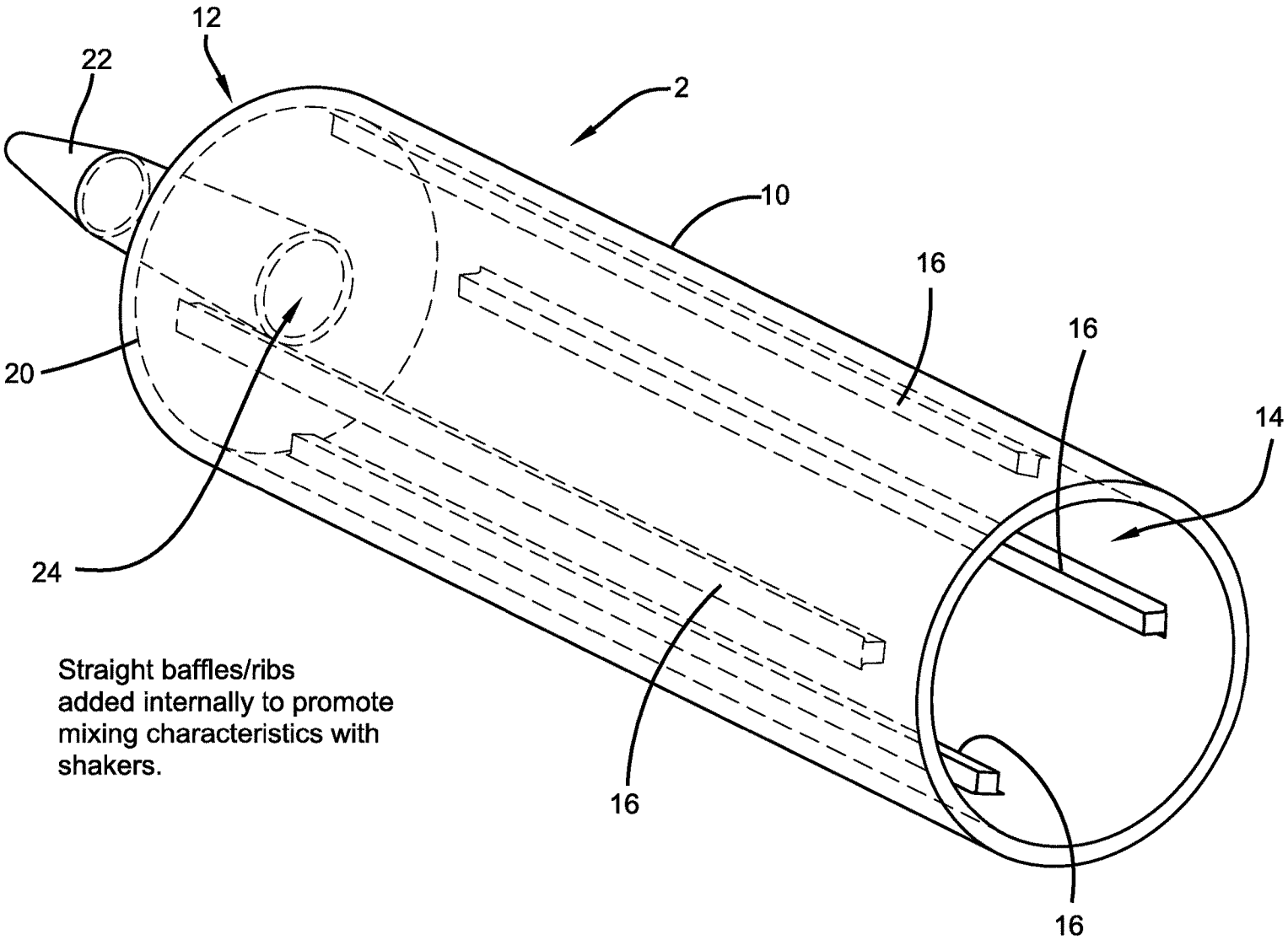
FIG. 2 illustrates a caulk tube in accordance with an embodiment of the invention.
Figure 3:
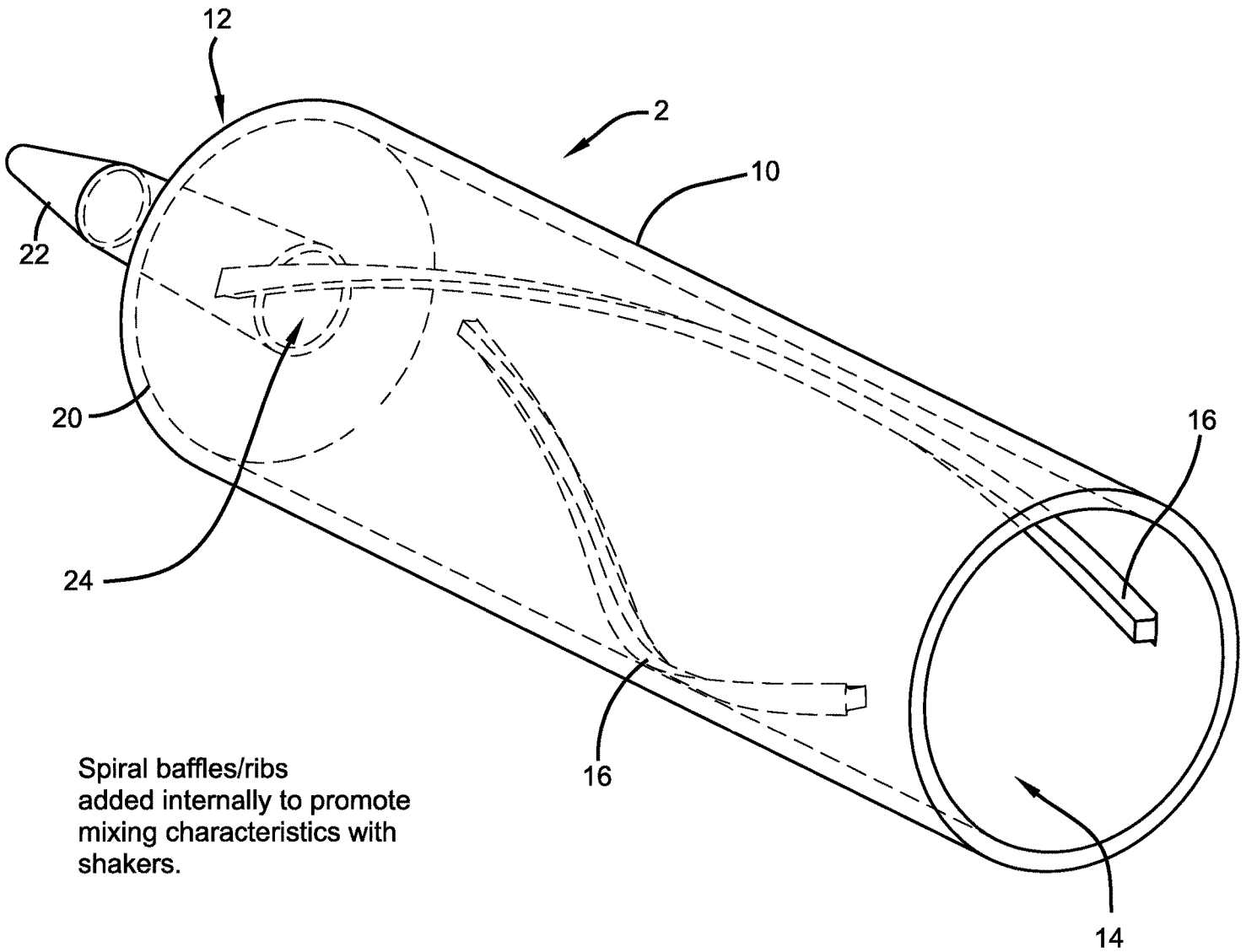
FIG. 3 illustrates a caulk tube in accordance with an embodiment of the invention.
Figure 4:
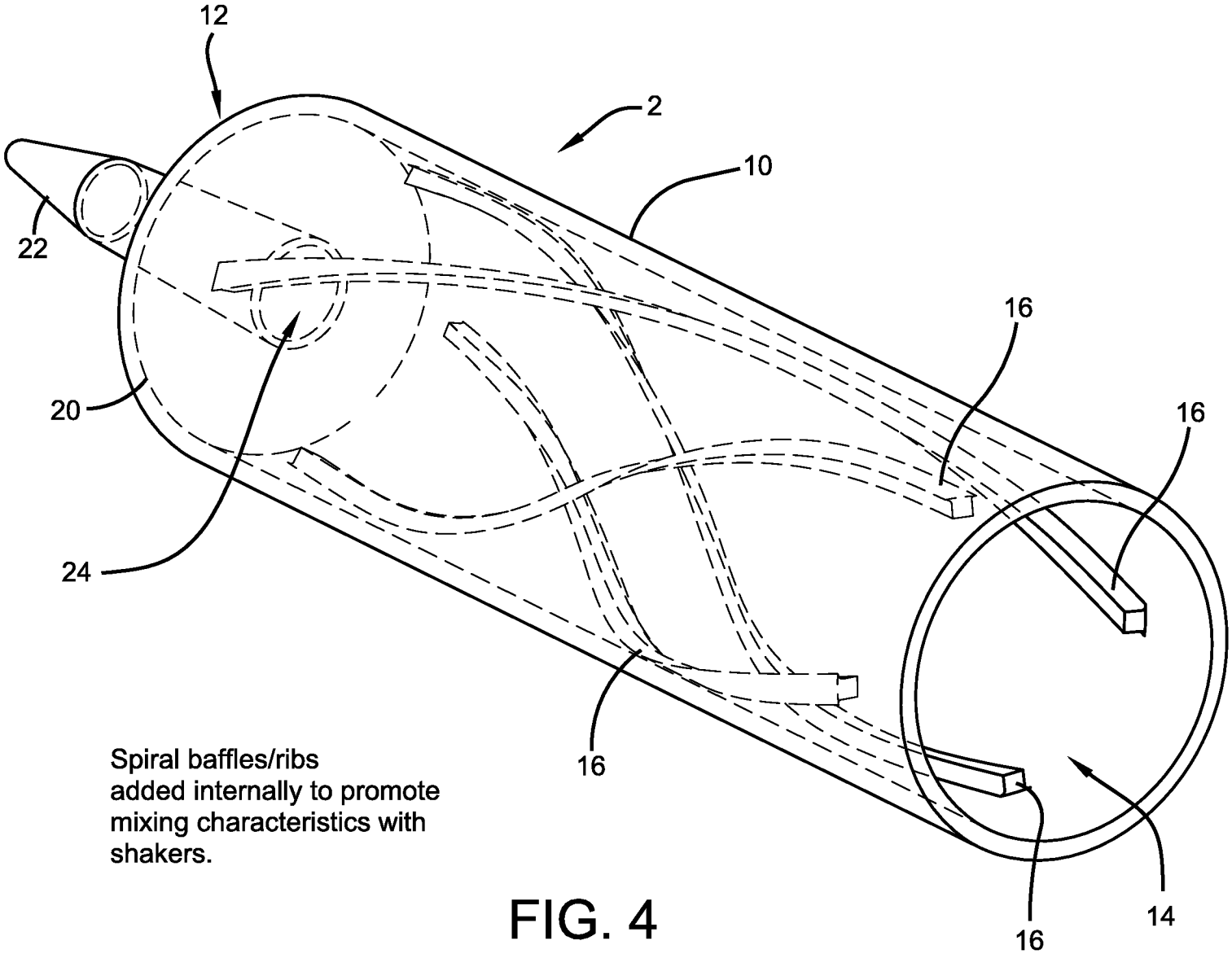
FIG. 4 illustrates a caulk tube in accordance with an embodiment of the invention.
Figure 5:
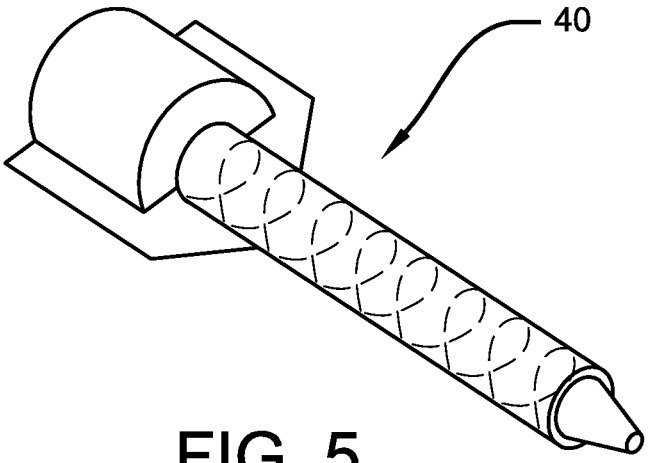
FIG. 5 illustrates a static mixing device in accordance with an embodiment of the invention.

As shown in FIGS. 1-4, the caulk tube of the present invention comprises one or more baffles 16 on the interior surface of the tube. In one embodiment, the baffles 16, may be integrally molded or formed as a unitary piece with the tube or may be later inserted and secured inside the tube. While the figures show embodiments comprises 2 or 4 baffles, it is contemplated by the present invention that any number of baffles could be employed. The baffles may have a variety of configurations, not limited to those in the attached drawings. By way of example, FIGS. 1 and 2 illustrate straight baffles oriented to run along the length of the tube. In another useful embodiment shown in FIGS. 3 and 4, the baffles may have a spiral pattern. The size of the baffles may be limited by the diameter and/or configuration of the auger. In another useful embodiment, the auger, piston or backplate may be configured, to accommodate the baffles, such as by having cutout sections which allow the auger, piston or backplate to slide along the baffles.

Typically, caulk compositions are white or neutral in color or are clear. The white, neutral, or clear caulk in the tube may be tinted at the point of purchase, such as to match a paint or tile color. A technician or worker at a store may remove the cap on the second end 14 of the caulk tube. In one useful embodiment, there is a space between the second end of the tube and the top of the caulk composition when the lid is removed. The worker can add a coloring composition such as a dye or tint coloring formula to the tube on top of the caulk. In one embodiment, instead of dye or tint, a paint composition, such as a tinted latex paint, may be used as the coloring composition. After the coloring composition has been added to the tube, the cap is replaced so that the coloring composition may be mixed into the caulk.

Figure 6:
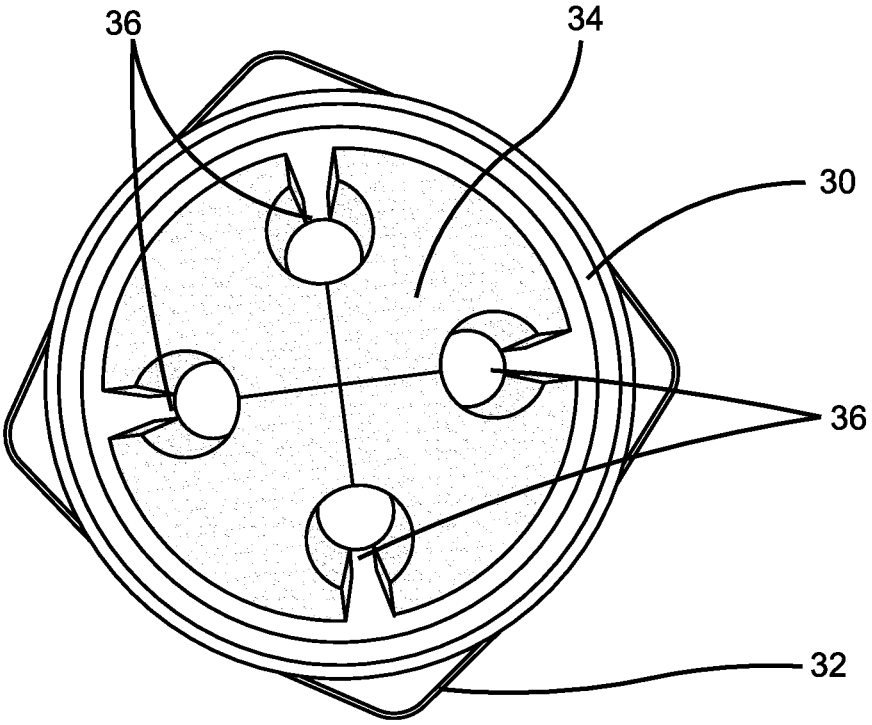
FIGS. 6-8 illustrates a adapter for mixing caulk in a paint shaker apparatus.
Figure 7:
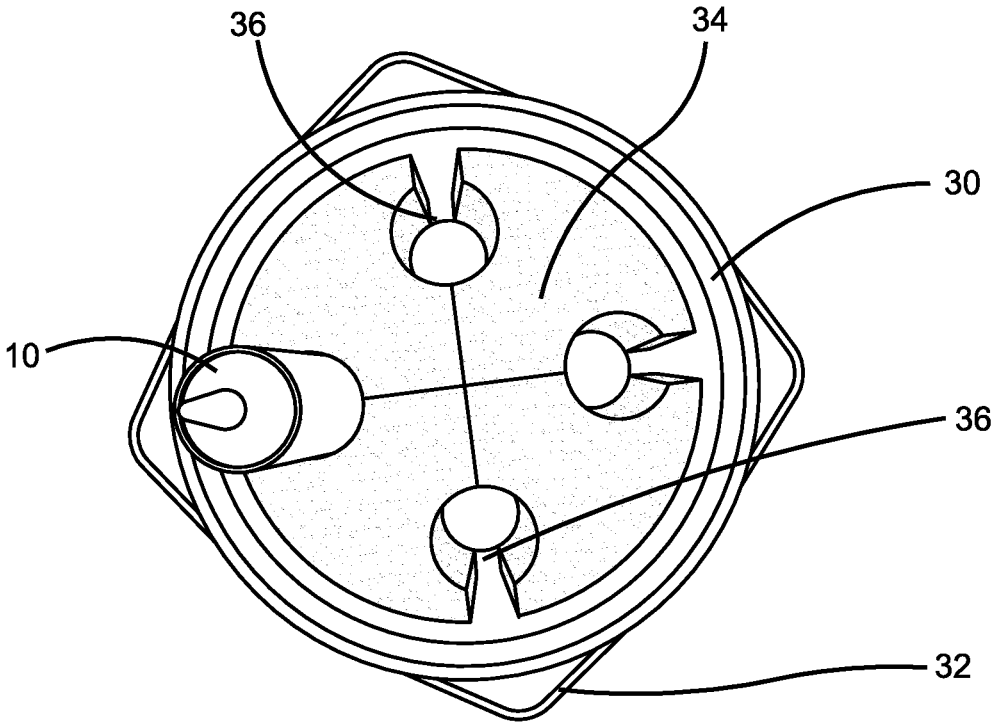
Figure 8:
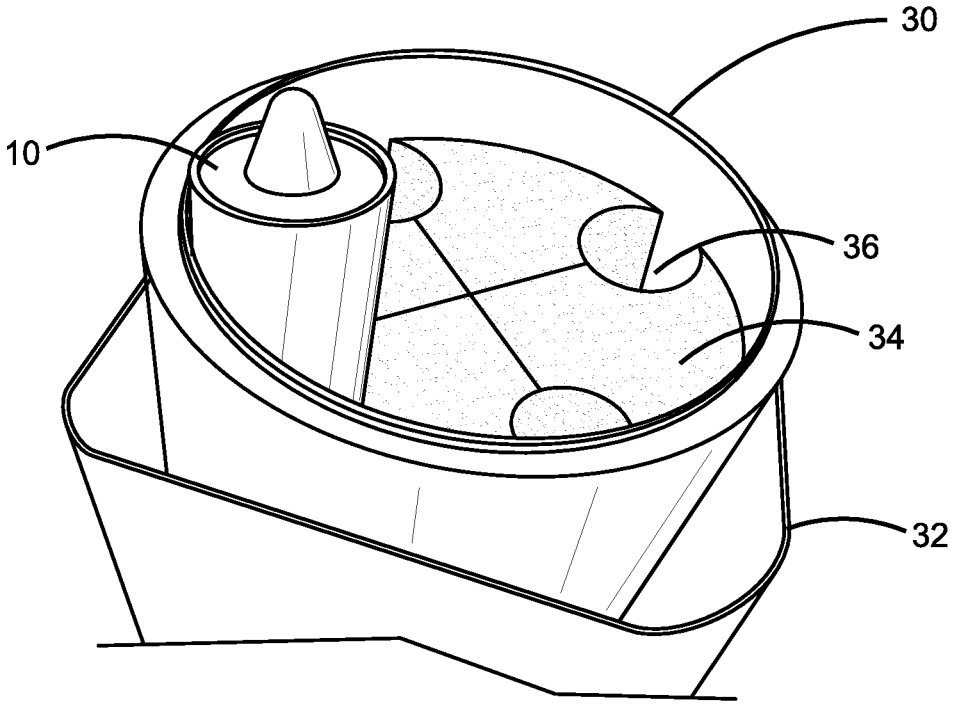
Figure 9:
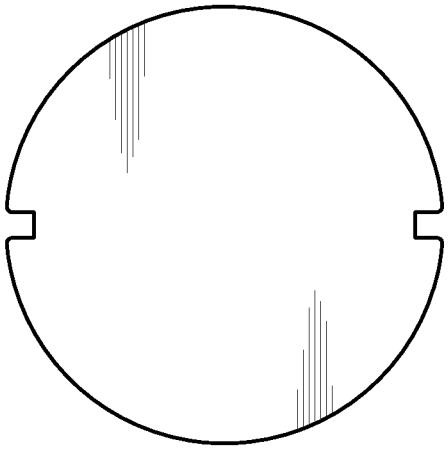
FIG. 9 illustrates an exemplary auger, piston or back plate having cut out sections which fit within the caulk tube of FIGS. 1 and 3.
Figure 10:
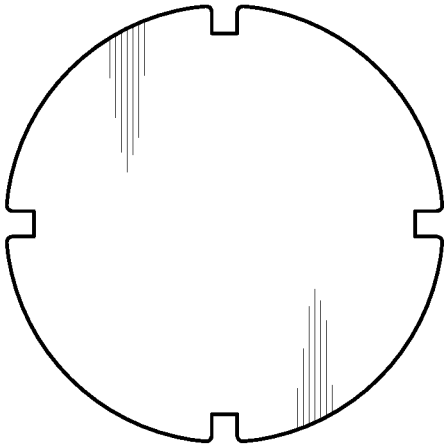
FIG. 10 illustrates an exemplary auger, piston or back plate having cut out sections which fit within the caulk tube of FIGS. 2 and 4.

In one useful embodiment, the caulk tube can be placed into an existing paint mixing machine or shaker in order to mix in the coloring composition. An adapter may be used to allow the caulk tubes to be mixed in paint shakers. For example, useful paint shaking machines and types of adapters are described in U.S. Pat. No. 6,817,751, U.S. Pat. No. 7,235,968, U.S. Pat. No. 7,445,373, and U.S. Pat. No. 7,077,560, all of which are hereby incorporated by reference. An adapter may be used to allow caulk tubes to be mixed in the paint shakers. For example, FIGS. 6-8 illustrate one embodiment of an adapter. An insert 30 resembling a round paint can may be placed in the bucket 32 in the paint shaker. Inside the insert is an adapter 34 configured to hold caulk tubes. The adapter 34 includes at least one opening 36 configured to hold a caulk tube 10. In one useful embodiment, the adapter 34 includes at least two openings 36. In one particularly useful embodiment, the adapter 34 includes an even number of openings 36. In one embodiment, the openings 36 are positioned such that pairs of tubes are positioned opposite of one another in order to provide proper balancing during mixing. In another useful embodiment, the round insert 30 is not needed and an adapter similar to the one shown in the drawings is positioned directly in the bucket 32.

A method in accordance with the present invention comprises the steps of providing a tube in accordance with the present invention containing a caulk composition, removing the removable cap from the second end of the tube, adding a coloring composition to the caulk in the tube through the opening in the second end 14, replacing the cap, placing the tube, or preferably at least two caulk tubes, containing caulk and coloring composition into an adapter in a paint mixing apparatus, and mixing the caulk and coloring composition in the paint mixing apparatus.

In another embodiment of the invention, the coloring composition may be mixed into the caulk or further mixed by means of a static mixer 40 included in or as part of the tip 22. As the caulk and coloring composition flow out of the static mixer tip 40, they are mixed together to have the desired color upon application.

While the present invention has been illustrated by the description of embodiments thereof, and while the embodiments have been described in considerable detail, it is not the intention of the applicants to restrict or in any way limit the scope of the appended claims to such detail. Additional advantages and modifications will readily appear to those skilled in the art. Therefore, the invention, in its broader aspects, is not limited to the specific details, the representative apparatus, and illustrative examples shown and described. Accordingly, departures may be made from such details without departing from the spirit or scope of the applicant's general inventive concept.

What is claimed is:

1. A caulk tube comprising a hollow tube having a first end comprising an end wall with an outlet opening, a second end comprising an opening, a removable cap positioned on the second end, a back plate for dispensing caulk from the tube, wherein the caulk tube has a uniform width between the first end and the second end wherein the caulk tube comprises four or more baffles on a smooth inside surface of the hollow tube, wherein at least one pair of parallel baffles and at least one pair of non-parallel baffles are oriented to run spirally within the tube along the length of the tube from the first end of the tube to the second end of the tube, wherein the caulk tube when loaded with caulk allows the caulk to be in direct contact with the four or more baffles on the smooth inside surface of the hollow tube, wherein the baffles comprise a uniform height, wherein the baffles promote the mixing of caulk within the caulk tube upon placing the caulk tube within a shaker and assist in obtaining a mixture which is sufficiently homogeneous to achieve a desired color upon application, wherein the back plate comprises cutout sections which fit over the baffles and allow the back plate to slide in a rotational manner along the smooth inside surface of the hollow tube, wherein the back plate is pushed along the hollow tube either manually or by use of a caulk gun.

2. The caulk tube in accordance with claim 1, wherein the caulk tube comprises four baffles.

3. The caulk tube in accordance with claim 1, further comprising a tip in fluid communication with the outlet opening.

4. The caulk tube in accordance with claim 3, wherein the tip comprises a static mixer.

5. A method of tinting a caulk composition comprising:

(a) providing a caulk tube according to claim 1, wherein the caulk tube is filled with caulk;

(b) removing the removable cap;

(c) placing a coloring composition in opening at the second end;

(d) replacing the cap on the second end of the caulk tube;

(e) providing a paint mixer having an adapter for accommodating caulk tubes;

(f) placing the caulk tube in the adapter, and (g) mixing the caulk and coloring composition using the paint mixer.

6. A caulk tube comprising a hollow tube having a first end comprising an end wall with an outlet opening, a second end comprising an opening, a removable cap positioned on the second end, a back plate for dispensing caulk from the tube, wherein the caulk tube comprises four or more baffles on a smooth inside surface of the hollow tube, wherein at least one pair of parallel baffles and at least one pair of non-parallel baffles are oriented to run spirally within the tube along the length of the tube from the first end of the tube to the second end of the tube, wherein the caulk tube is loaded with caulk in a first portion of the tube and the caulk tube is loaded with a coloring composition in a second portion of the tube, and wherein the caulk and the coloring composition are in direct contact with the four or more baffles on the smooth inside surface of the hollow tube, wherein the baffles comprise a uniform height, wherein the baffles promote the mixing of caulk within the caulk tube upon placing the caulk tube within a shaker and assist in obtaining a mixture which is sufficiently homogeneous to achieve a desired color upon application, wherein the back plate comprises cutout sections which fit over the baffles and allow the back plate to slide in a rotational manner along the smooth inside surface of the hollow tube, wherein the back plate is pushed along the hollow tube either manually or by use of a caulk gun.

7. The caulk tube of claim 6, wherein the coloring composition is loaded adjacent the second end of the caulk tube over the caulk composition.

8. The caulk tube of claim 6, wherein the caulk tube further comprises a tip in fluid communication with the outlet opening.

9. The caulk tube of claim 8, wherein the tip is removable from the caulk tube.

* * * * *